US006332560B1

(12) United States Patent
Rosenberg

(10) Patent No.: US 6,332,560 B1
(45) Date of Patent: Dec. 25, 2001

(54) COLLAPSIBLE DISPENSING TUBE

(76) Inventor: Max Rosenberg, 800 Rue Ramport, Suite 332, Metairie, LA (US) 70005

( * ) Notice: Subject to any disclaimer, the term of this patent is extended or adjusted under 35 U.S.C. 154(b) by 0 days.

(21) Appl. No.: 09/730,810

(22) Filed: Dec. 7, 2000

(51) Int. Cl.[7] ..... B65D 35/08
(52) U.S. Cl. ..... 222/107; 222/92
(58) Field of Search ..... 222/92, 95, 99, 222/107

(56) References Cited

U.S. PATENT DOCUMENTS

| | | | | |
|---|---|---|---|---|
| 1,370,264 | | 3/1921 | Bachmann | 222/107 |
| 2,430,046 | | 11/1947 | Dreyfus | 222/107 |
| 3,160,323 | * | 12/1964 | Weisberg | 222/107 |
| 3,198,392 | | 8/1965 | Wilson et al. | 222/107 |
| 3,211,342 | | 10/1965 | De Wayne Miles | 222/107 |
| 3,260,412 | | 7/1966 | Larkin | 222/107 |
| 3,335,912 | | 8/1967 | Reeves, Jr. | 222/94 |
| 3,401,837 | | 9/1968 | Wiedeman | 222/107 |
| 3,458,087 | | 7/1969 | Cox, Jr. | 222/99 |
| 3,508,587 | * | 4/1970 | Mauch | 222/107 X |
| 4,235,653 | | 11/1980 | Ausnit | 156/91 |
| 4,733,800 | * | 3/1988 | Bjorkengren et al. | 222/107 |
| 4,807,782 | | 2/1989 | Meinerding et al. | 222/107 |
| 5,167,349 | | 12/1992 | Rodder et al. | 222/107 |
| 5,344,049 | | 9/1994 | MacDonald | 222/107 |
| 5,373,968 | | 12/1994 | Nelson | 222/99 |
| 5,467,897 | | 11/1995 | Williams | 222/107 |
| 5,732,854 | | 3/1998 | Ruben et al. | 222/99 |
| 5,857,593 | | 1/1999 | Patronaggio | 222/103 |
| 5,884,811 | | 3/1999 | Bunchman | 222/92 |

FOREIGN PATENT DOCUMENTS 34 30 677 11/1985 (DE) .

* cited by examiner

*Primary Examiner*—Kenneth Bomberg
(74) *Attorney, Agent, or Firm*—Nixon & Vanderhye P.C.

(57) ABSTRACT

A collapsible dispensing tube such as a toothpaste tube or the like includes structure for maintaining the dispensing tube in a coiled position as the viscous material within the dispensing tube is expelled. The tube is provided with a slot formed in a first side of its exterior surface and a plurality of engaging elements positioned on a second side of the exterior surface. The slot and engaging elements are correspondingly sized such that the slot receives the engaging elements securely when the engaging element side of the tube is coiled onto the slot side of the tube. This construction readily prevents a dispensing tube from uncoiling to thereby more efficiently dispense the material within the tube.

12 Claims, 1 Drawing Sheet

COLLAPSIBLE DISPENSING TUBE

BACKGROUND OF THE INVENTION

The present invention relates generally to a collapsible dispensing tube and, more particularly, to a collapsible dispensing tube including exterior structure for securing the tube in various coiled positions.

As is well known, many types of viscous materials, such as gels, liquids, pastes and the like, are sold in flexible tubes having a sealed crimp at one end and a narrow nozzle at an opposite end with closing structure such as a valve or cap thereon. These tubes may be made from many materials, but a majority of them are made from flexible plastic via an injection molding process. The viscous material to be dispensed from the flexible tube is generally inserted in one end, and this end is then sealed to form an embossed, crimped end seal.

In order to expel the viscous material, the tube can be squeezed or otherwise deflected inwardly with the closure removed from the nozzle. For reasons of economy, it is preferable to exhaust the supply of material in a tube before discarding it. In this context, it has been found that coiling the tube or rolling the tube upon itself can most efficiently expel the material while preventing the material from migrating away from the cap end of the tube. There is a tendency, however, for the tube to uncoil, enabling the material to migrate while also encouraging users to squeeze the tube from the middle or top near the cap rather than more efficiently from the bottom.

There have been a number of attempts made to provide suitable clips and retaining clamps and the like for such tubes, but they are generally ineffective or overly complicated. There thus remains a need for a collapsible tube that includes structure for controlling the tendency of the tube to uncoil and yet is convenient to use and inexpensive to implement.

SUMMARY OF THE INVENTION

The solution according to the present invention incorporates a hook and slot arrangement on opposite sides of the collapsible tube. As the tube is coiled or rolled upon itself to expel the viscous material, the engaging elements on one side of the tube are brought into engagement with the slot on the opposite side of the tube and secured. Since a plurality of the engaging elements are arranged along a longitudinal axis of the tube, successive engaging elements from the crimped end of the tube toward the cap end of the tube are inserted into the slot with increased coiling or rolling of the tube onto itself. The hook and slot arrangement thus prevents the plastic tube from uncoiling and thus more efficiently dispenses the material from the tube.

In an exemplary embodiment of the present invention, a collapsible dispensing tube including a tube exterior surface comprises a slot formed in a first side of the tube exterior surface, and a plurality of engaging elements positioned on a second side of the tube exterior surface, opposite from the first side. The slot and engaging elements are correspondingly sized such that the slot receives the engaging elements securely when the second side of the tube exterior surface is rolled onto the first side of the tube exterior surface. Preferably, the slot and engaging elements are correspondingly sized such that the slot receives the engaging elements in a snap fit. The engaging elements may be formed integral with the tube exterior surface, and the slot may be formed integral with the tube exterior surface. The slot may comprise a substantially C-shaped groove in the tube exterior surface, wherein an opening of the substantially C-shaped groove is smaller than a width of the engaging elements. Preferably, the tube is formed of plastic.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
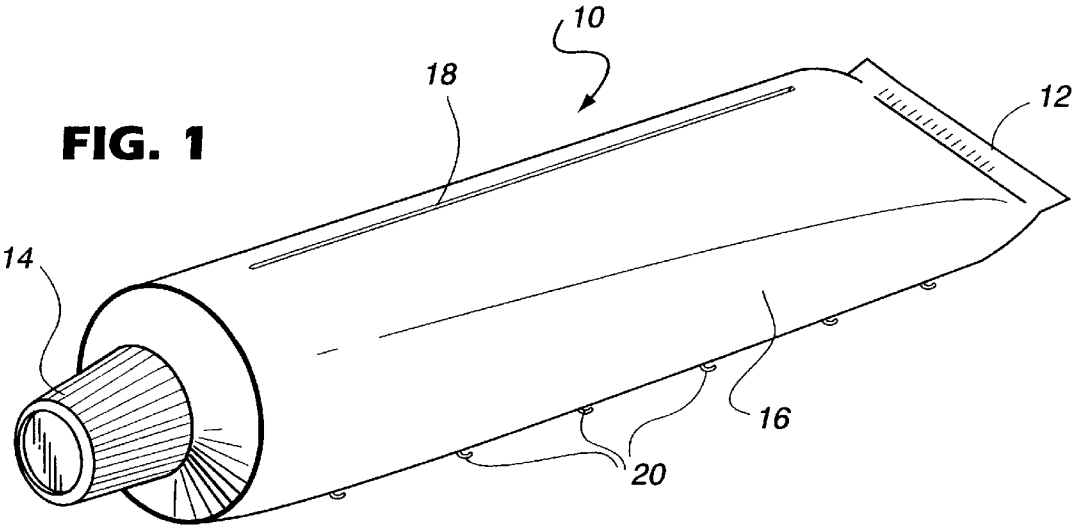
FIG. 1 is a perspective view of the collapsible dispensing tube according to the present invention.

Referring to the drawings, the collapsible tube 10 according to the present invention is preferably formed of a plastic material with a sealed crimp 12 at one end and a cap 14 or other suitable closure means at an opposite end as is conventional. As would be apparent to those of ordinary skill in the art, the tube 10 can be formed of many suitable materials of varying degrees of pliability, and the invention is not necessarily meant to be limited to plastic.

Figure 2:
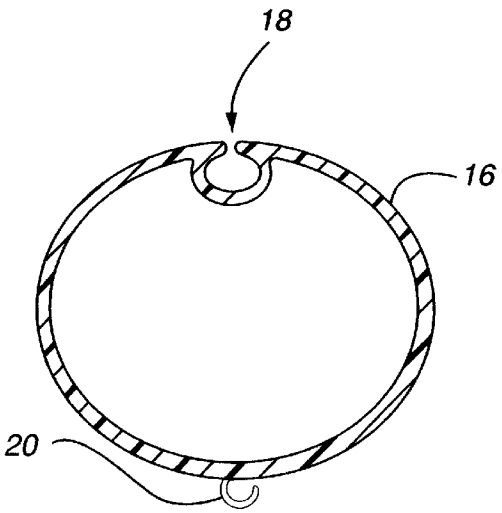
FIG. 2 is a cross sectional view of the dispensing tube according to the present invention.

The body of the tube 10 includes an interior surface that delimits an interior space for a viscous material such as toothpaste to be expelled from the tube. As is conventional, expelling the viscous material from the tube can be efficiently accomplished by coiling or rolling the tube onto itself as shown, for example, in FIG. 3. An exterior surface 16 of the tube is provided with structure that prevents a coiled or rolled tube from uncoiling. As shown in FIG. 2, a slot 18 is formed in one side of the tube exterior surface 16, and a plurality of engaging elements 20 are positioned on an opposite side of the tube exterior surface. The engaging elements 20 are aligned along a substantially central longitudinal axis of the respective side of the tube exterior surface 16 as shown in the drawings. The slot 18 and engaging elements 20 are preferably correspondingly sized and/or shaped such that the slot receives the engaging elements securely when the engaging element side of the tube exterior surface 16 is rolled onto the slot side of the tube exterior surface 16. In an alternative example, the slot or groove 18 may be provided as a ladder arrangement of stacked horizontal grooves along the length of the tube.

As shown, the slot 18 is preferably C-shaped, and a preferred shape for the engaging elements 20 is a hook-like shape or a J-shape. In this context, however, the engaging elements 20 could be formed of any shape in complement with a correspondingly shaped slot 18. For example, the engaging elements 20 could be circular, pointed, flat or of any other configuration that is capable of securely engaging a correspondingly sized and/or shaped slot 18. The invention is thus not necessarily meant to be limited to the illustrated example.

Figure 3:
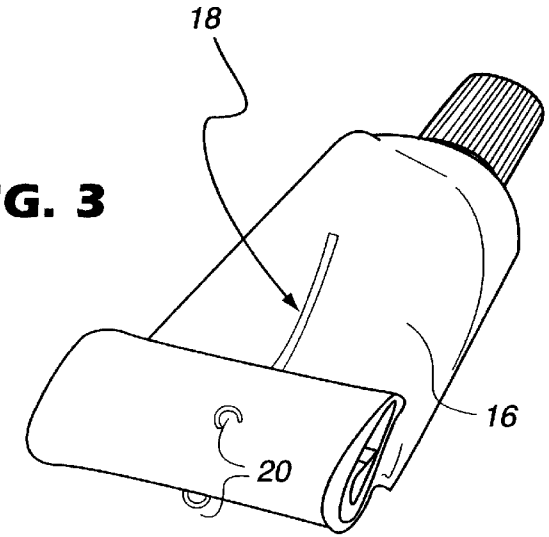
FIG. 3 shows the collapsible dispensing tube in a coiled state rolled upon itself with the tube engaging elements engaging the tube slot.

As mentioned, it is conventional to coil or roll collapsible tubes containing a viscous material to efficiently dispense the viscous material. As shown in FIG. 3, the structure according to the present invention serves to secure a coil dispensing tube in its coiled state and prevent the coiled tube from uncoiling. As the tube is rolled onto itself, the engaging elements 20 are engaged with the slot 18. Preferably, the engaging elements 20 are pressed into the slot 18 in a snap fit. Although the opening of the C-shaped slot 18 is smaller than a width of the engaging elements 20, pressing the engaging elements 20 into the slot 18 causes the slot 18 to deflect and receive the engaging elements 20. Once the engaging element is received, the slot 18 regains its original shape via the plastic or like constructed material and secures the engaging elements 20 therein. Since it is not intended that the collapsible dispensing tube would be uncoiled by the user, the slot 18 and engaging elements 20 can be configured to effect a secure engagement that is difficult to disengage. This construction, however, could of course be varied to suit various intended uses as would be apparent to those of ordinary skill in the art.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A collapsible dispensing tube including a tube exterior surface, the tube comprising:

a slot formed in a first side of the tube exterior surface; and a plurality of engaging elements positioned on a second side of the tube exterior surface, opposite from the first side, wherein the slot and engaging elements are correspondingly sized such that the slot receives the engaging elements securely when the second side of the tube exterior surface is coiled onto the first side of the tube exterior surface.

2. A collapsible dispensing tube according to claim 1, wherein the slot and engaging elements are correspondingly sized such that the slot receives the engaging elements in a snap fit.

3. A collapsible dispensing tube according to claim 1, wherein the engaging elements are formed integral with the tube exterior surface.

4. A collapsible dispensing tube according to claim 3, wherein the slot is formed integral with the tube exterior surface.

5. A collapsible dispensing tube according to claim 1, wherein the slot comprises a substantially C-shaped groove in the tube exterior surface, and wherein an opening of the substantially C-shaped groove is smaller than a width of the engaging elements.

6. A collapsible dispensing tube according to claim 1, wherein the tube is formed of plastic.

7. A collapsible dispensing tube including a sealed crimp at one end and a cap at an opposite end, the tube having an exterior surface and an interior surface delimiting an interior space for a viscous material to be expelled from the tube by rolling the tube onto itself, the tube comprising:

a slot formed in a first side of the exterior surface; and a plurality of engaging elements positioned on a second side of the tube exterior surface, opposite from the first side, wherein the engaging elements are sized to fit securely in the slot.

8. A method of manufacturing a collapsible dispensing tube including a tube exterior surface, the method comprising:

(a) forming a slot in a first side of the tube exterior surface; and (b) positioning a plurality of engaging elements on a second side of the tube exterior surface, opposite from the first side, wherein the slot and engaging elements are correspondingly sized such that the slot receives the engaging elements securely when the second side of the tube exterior surface is coiled onto the first side of the tube exterior surface.

9. A method according to claim 8, wherein steps (a) and (b) are practiced by sizing the slot and engaging elements correspondingly such that the slot receives the engaging elements in a snap fit.

10. A method according to claim 8, wherein step (b) is practiced by forming the engaging elements integral with the tube exterior surface.

11. A method according to claim 10, wherein step (a) is practiced by forming the slot integral with the tube exterior surface.

12. A method according to claim 8, wherein step (a) is practiced by forming a substantially C-shaped groove in the tube exterior surface, wherein an opening of the substantially C-shaped groove is smaller than a width of the engaging elements.

* * * * *